US011141877B2

(12) United States Patent
Peck

(10) Patent No.: US 11,141,877 B2
(45) Date of Patent: Oct. 12, 2021

(54) SYSTEM OF CHIPPER KNIVES AND KNIFE STOPS

(71) Applicant: Valmet Technologies, Inc., Espoo (FI)

(72) Inventor: Derrel M. Peck, Inlet Beach, FL (US)

(73) Assignee: VALMET TECHNOLOGIES, INC., Espoo (FI)

( * ) Notice: Subject to any disclaimer, the term of this patent is extended or adjusted under 35 U.S.C. 154(b) by 187 days.

(21) Appl. No.: 16/583,563

(22) Filed: Sep. 26, 2019

(65) Prior Publication Data

US 2020/0353641 A1 Nov. 12, 2020

Related U.S. Application Data

(60) Provisional application No. 62/845,265, filed on May 8, 2019.

(51) Int. Cl.

| | |
|---|---|
| ***B27L 11/02*** | (2006.01) |
| ***B27L 11/00*** | (2006.01) |
| ***B02C 18/18*** | (2006.01) |

(52) U.S. Cl.

CPC ..... *B27L 11/005* (2013.01); *B02C 18/184* (2013.01); *B27L 11/02* (2013.01)

(58) Field of Classification Search

CPC ..... B27G 13/02; B27G 13/04; B27G 13/08; B27G 13/10; B27L 11/005; B27L 11/02; B27L 11/04; B27L 11/06; B27L 11/08; B02C 18/18; B02C 18/182; B02C 18/184; B02C 18/186

See application file for complete search history.

(56) References Cited

U.S. PATENT DOCUMENTS

| | | | | |
|---|---|---|---|---|
| 4,784,337 A * | 11/1988 | Nettles | B27G 13/10 | 144/176 |
| 4,887,772 A | 12/1989 | Robinson et al. | | |
| 4,972,888 A * | 11/1990 | Dean | B27L 11/005 | 144/172 |
| 5,305,811 A * | 4/1994 | Schaefer | B27L 11/005 | 144/176 |

(Continued)

FOREIGN PATENT DOCUMENTS

| | | |
|---|---|---|
| DE | 2411978 A1 | 9/1975 |
| DE | 2722280 A1 | 11/1978 |

(Continued)

OTHER PUBLICATIONS

Valmet Technical Paper Series, "The Total Woodyard", 28 pp., published Jun. 12, 2015.

*Primary Examiner* — Matthew Katcoff
(74) *Attorney, Agent, or Firm* — Stiennon & Stiennon

(57) ABSTRACT

A disc chipper has thick double-edged chipper blades clamped in rectangular pockets between a knife segment and a knife clamp which are connected to a chipper disc. The blades are precisely positioned for cutting by knife stops selected from a set of knife stops of incremental modular widths. A different width knife stop is used to position the chipper knife blades each time it is sharpened. After each sharpening the knife blade has a selected width which is smaller by a constant incremental value, and it is assembled with a mating knife stop from the set so that the blade edge position remains unchanged.

14 Claims, 4 Drawing Sheets

(56) References Cited

U.S. PATENT DOCUMENTS

| | | | | |
|---|---|---|---|---|
| 5,348,064 | A * | 9/1994 | Nettles | B27L 11/005 144/162.1 |
| 5,456,300 | A * | 10/1995 | Rosenkranz | B27G 13/04 144/174 |
| 5,937,923 | A | 8/1999 | Bielagus et al. | |
| 6,347,456 | B1 | 2/2002 | Jones et al. | |
| 7,182,112 | B2 | 2/2007 | Meados | |
| 7,293,730 | B2 | 11/2007 | Jonkka | |
| 7,584,772 | B2 | 9/2009 | Jonkka | |
| 8,051,887 | B2 * | 11/2011 | Robinson | B27L 11/005 144/373 |
| 2004/0060616 | A1 | 4/2004 | Jonkka et al. | |

FOREIGN PATENT DOCUMENTS

| | | | |
|---|---|---|---|
| DE | 3506252 | A1 | 8/1986 |
| WO | 9628287 | A1 | 9/1996 |

* cited by examiner 100
102
91
98
35
33
31
29
A 52
47
30
41
38

20
44
40
41
38
52
30

SYSTEM OF CHIPPER KNIVES AND KNIFE STOPS

CROSS REFERENCES TO RELATED APPLICATIONS

This application claims the benefit of priority of U.S. provisional App. No. 62/845,265 filed on May 8, 2019, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to disc chippers and the chipper knives mounted thereto which are used to reduce logs to wood chips for further processing, e.g., chemical cooking to extract wood fiber for making a fiber web.

Debarked wood logs are pushed against a chipper disk typically by arranging a log supply chute so that gravity provides the force to feed the logs against the chipper disk. Chipper knives are mounted to the chipper disk so that the knives slice the log into chips. Depending on the species of wood and the condition of the wood, e.g. frozen or not, the length of time before the chipper disk knives need to be sharpened can vary between hours and days. The cost and labor involved in removing, sharpening and replacing the chipper knives is an important contributor to the overall cost of the chipping process.

Chipper knives are typically mounted between a knife segment, and a knife clamp which are bolted to a chipper disk. The chipper disc is mounted to an axis shaft which is driven to rotate. The process of removing and replacing the chipper knives is effected by loosening the knife clamps so the chipper knives can be removed and replaced. The knife clamps are mounted to the chipper disk by spring-loaded bolts which pull the knife clamps away from the knife segments and towards the chipper disk. A second set of bolts are arranged to push the knife clamp towards the chipper knives, thus clamping them between the knife clamp and the knife segment. When this second set of bolts is loosened, the knife clamps are pulled away from the knife segments by the first bolts, allowing the chipper knives to be removed. The chipper knives can be sharpened on one side or on both sides. U.S. Pat. No. 7,584,772 shows in FIG. 5 a double-edged chipper blade which has a groove which mounts the chipper blade to a projection on the knife clamp. When one side of the blade becomes dull the chipper knife can be removed and reversed to bring the second knife edge into position for chipping. A chipper blade must be properly positioned to function properly in the disk chipper to which it is mounted. For the double-sided chipper blade shown in FIG. 5 of U.S. Pat. No. 7,584,772 the corresponding groove in the blade and projection in the knife clamp properly position the knife for each of the two edges. After both edges of the chipper knife have become dull the chipper knife is replaced, because sharpening the chipper knife would not result in the cutting edge being properly positioned.

Single bladed chipper knives can be sharpened many times and be properly positioned after each sharpening of the blade by forming a shim of Babbitt metal to lengthen the knife blade, so the sharpened edge is again correctly positioned. The ability to sharpen the chipper blade many times allows the use of a thicker blade because material cost of the blade becomes less significant. A thicker blade also has the advantage that less damage is done to the blade and the disc chipper when tramp metal or a stone finds its way into the disc chipper. However, using Babbitt metal to form a shim is time-consuming because the Babbitting step must be performed each time the chipper knife is sharpened and Babbitting requires handling hot molten metal.

SUMMARY OF THE INVENTION

A disc chipper employs a thick double-edged chipper blade in combination with a set of a plurality of knife stops, a different one of the knife stops is used to position the chipper knife each time the double-sided chipper knife is sharpened. The process of sharpening the double-edged chipper blade is performed such that after sharpening the blade has a selected width which is smaller by a constant incremental value. For example, if the double-edged blade starts out being 4½ inches wide, after sharpening it will have a width that is ⅛ inch smaller, e.g., 4⅜ inches. Thus, in the example of the increment being one eighth inch, after each sharpening the blade width is reduced by a like amount such that after the blade has been sharpened twelve times the blade width is reduced to 3 inches. For each of the twelve successive sharpening steps one of twelve additional incrementally longer knife stops are used, with each successive knife stop being ⅛ of an inch longer, such that the width of the combination of knife stop and the knife blade always adds up to the same width, so that the sharpened edge of the chipper knife is always properly positioned. A rectangular pocket is formed between a knife clamp and a knife segment which holds the knife stop and the chipper knife aligned one with the other so that together the chipper knife and blade stop have a constant width which positions a cutting edge of the chipper knife for chipping.

Knife segments together with knife clamps which form the rectangular pocket are bolted to the chipper disc. The knife clamps are under the knife segments and the knife clamps are mounted to the chipper disk by first spring-loaded bolts which pull the knife clamp away from the knife segment and towards the chipper disk. Second bolts mounted to the chipper plate are used to push the chipper knife clamps against the knife segment. By loosening the second bolts which clamp the knife clamps against the knife segment, the chipper knives may be removed and reversed so the second knife edge is brought into use.

After both sides of the chipper knives are dulled by use, the chipper knives are removed and sharpened. After the chipper knives have been sharpened they may be returned to cutting position, but, because sharpening changes the dimensions of the knives, the knife stops must be switched out with different ones from the set of modular knife stops. The knife stops are removed while the second bolts are loose by withdrawing them from the rectangular pockets formed between the knife clamps and the knife segments. Although the chipper knives, which may be composed of one or several segments, are easily withdrawn from the rectangular pockets as one edge of each knife extends beyond the rectangular pockets, the knife stops are less easily removed. The knife stops are considerably shorter length than the chipper knives with one knife stop positioned on either end of each chipper blade and are held in place by magnets mounted in a surface of the knife segment which forms a upper portion of the rectangular pocket. The knife stops have angled surfaces which engage the angled surface of one of the knife edges. Each angled surface of each knife stop has a threaded hole which extends parallel to and partially along the width of the knife stop. The threads in the hole within a knife stop can be selectively engaged by a simple T-shaped tool which is threaded on one end to engage with the threaded hole in the knife stop. The tool and knife stop combination may then be drawn out of the rectangular pocket and away from the positioning magnet mounted in the surface of the knife segment. A new set of knife stops can be inserted using the same T-shaped tool. The new knife stops have a greater width to properly position the chipper knife segments as shortened by sharpening. Once the knife stops are positioned the positioning magnets mounted in the surface of the knife segment hold the knife stops until the sharpened chipper knife is positioned and clamped by the tightening of the second bolts of the knife clamps. Counter knives are mounted to the knife clamps on a portion of the knife clamp which forms a groove beneath the chipper knives so that the chipper knives are supported on the counter knives. Magnets are mounted to hold the counter knives on the bottom of the counter knife grooves to hold the counter knives in position when the second bolts are loosened so the chipper knives and the knife stops can be removed.

DESCRIPTION OF THE PREFERRED EMBODIMENTS

Figure 1:
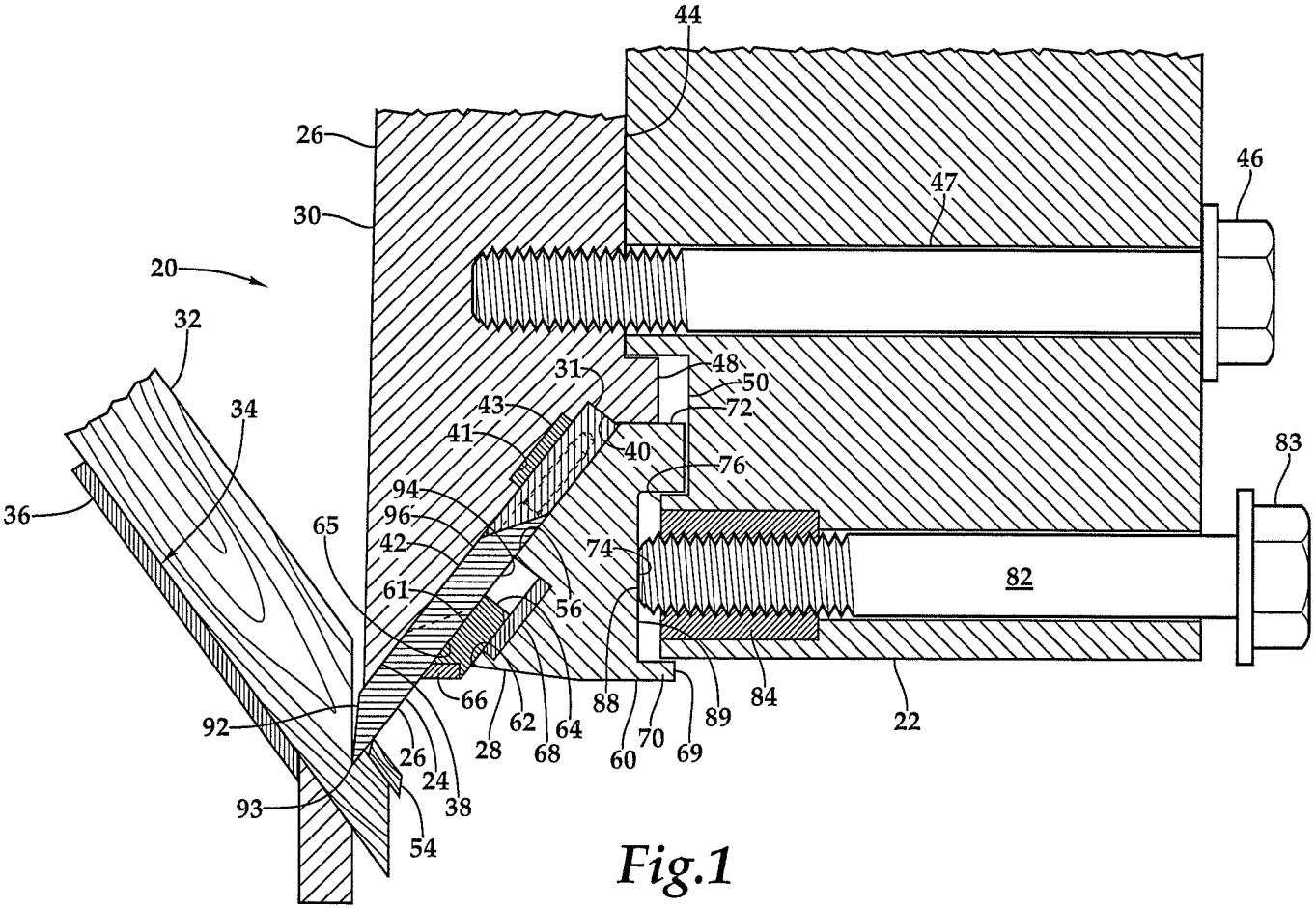
FIG. 1 is a fragmentary cross-sectional view of the chipper knife and knife stop arrangement of the invention taken along section line 1-1 of the knife clamp of FIG. 6.

Referring more particularly to FIGS. 1-6 wherein like numbers refer to similar parts a portion of a disc chipper 20 is shown in FIG. 1. The disk chipper 20 has a chipper disc 22 which is mounted for rotation in the disc chipper and to which a plurality of chipper knives 24 are mounted. Each chipper knife 24 has two parallel and opposite cutting edges 93 spaced from one another in a width direction. The chipper knife 24 body has a bottom surface 94 which is parallel to a top surface. The cutting edges 93 are defined by inclined edge planes 92 extending from the top surface 96 outwardly to the bottom surface 94. The chipper knife is symmetrical about a central plane which is perpendicular to the top surface 96 and the bottom surface 94.

A knife segment 26 is fixedly bolted to the chipper disk 22, and a knife clamp 28 is also bolted to the chipper disc, with a rectangular pocket 42 being thus defined between the knife segment 26 and the knife clamp 28. The laterally extending chipper knives 24 are clamped in the pockets 42, and may be comprised of two similar parts of half the length. The shorter knife parts facilitate machine sharpening.

Figure 2:
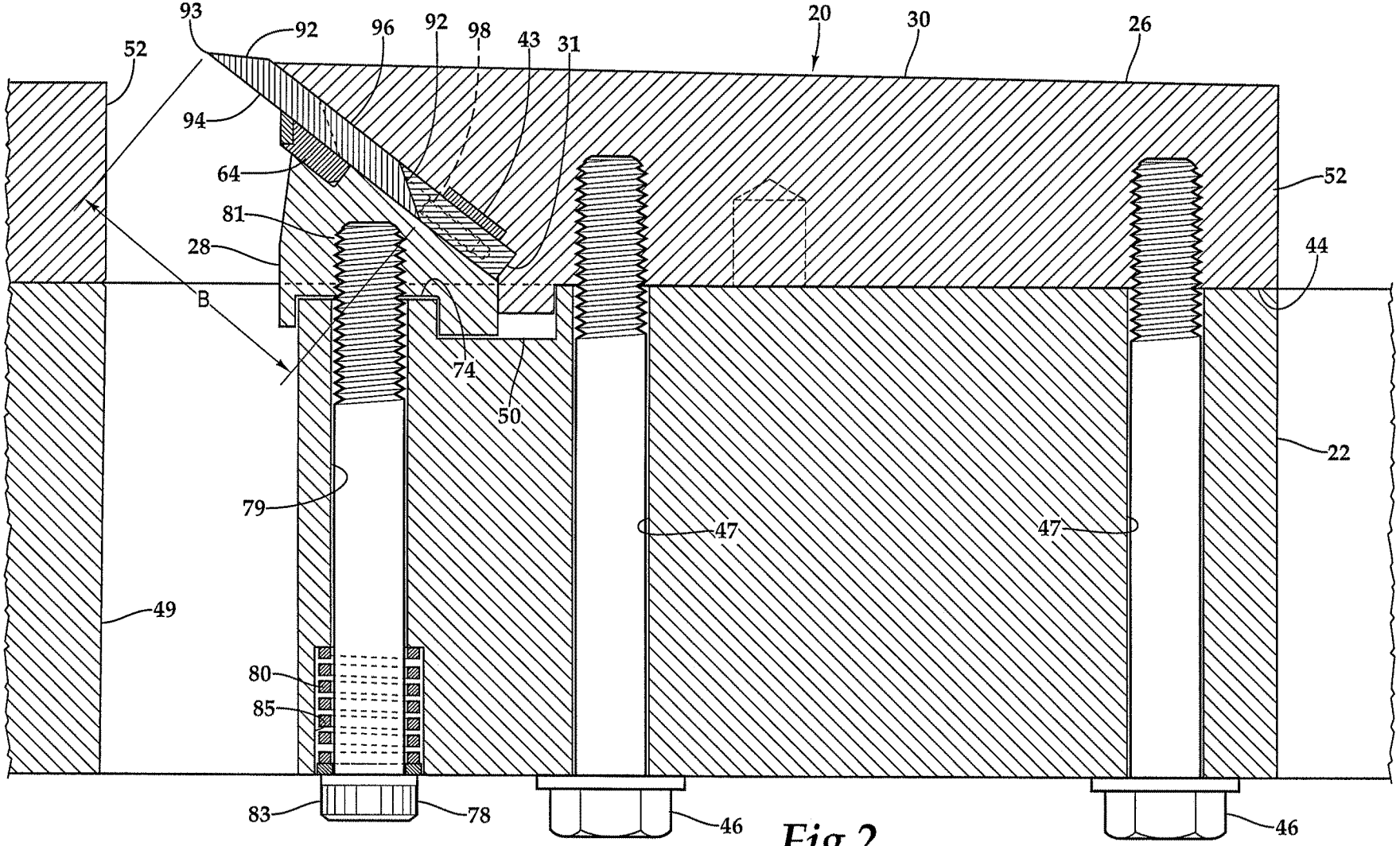
FIG. 2 is a fragmentary cross-sectional view of the chipper knife and knife stop arrangement of FIG. 1 taken along section line 2-2 of the knife clamp of FIG. 6.
Figures 3, 4A, 4B:
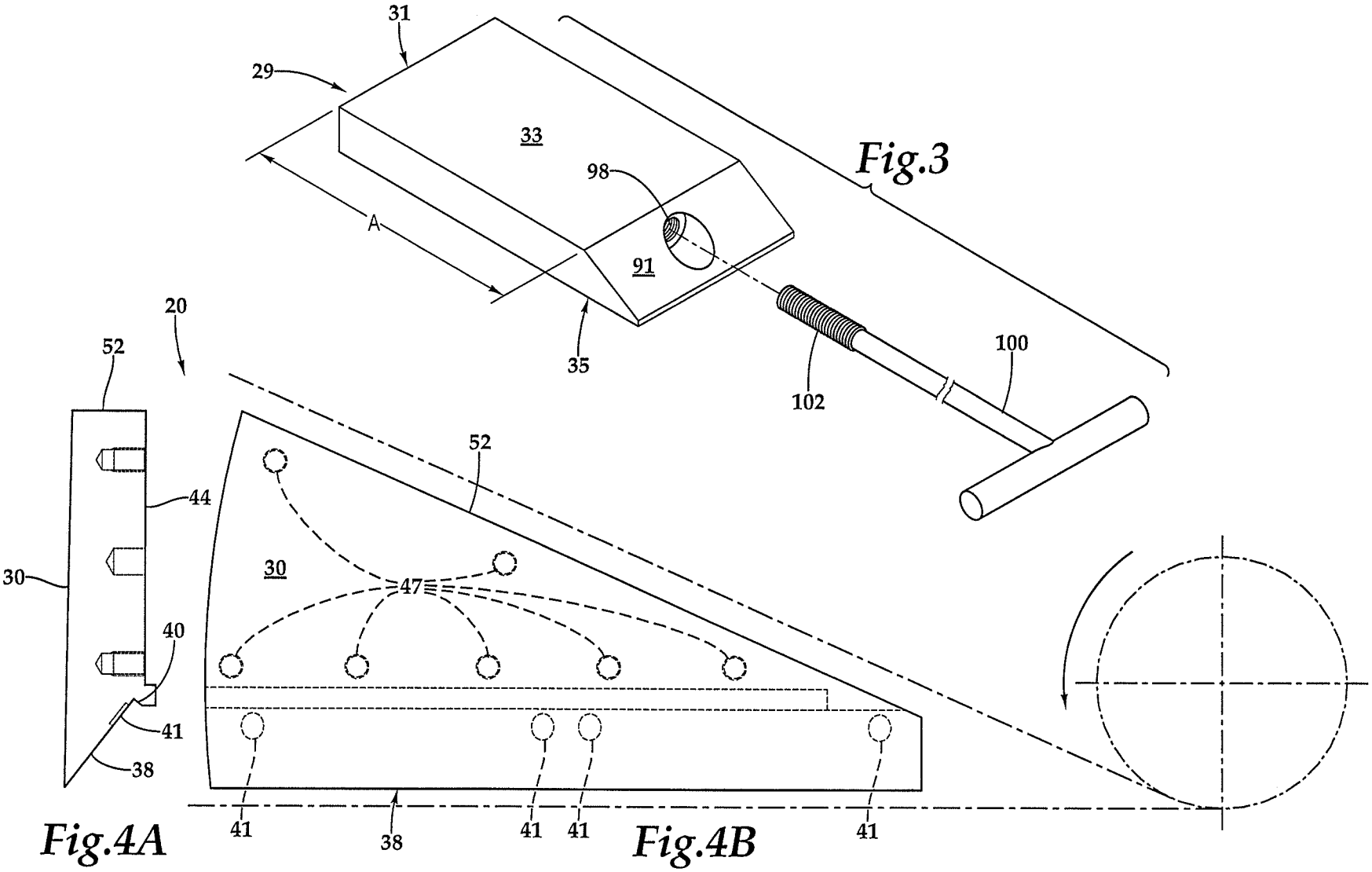
FIG. 3 is an exploded isometric view of the knife stop of FIG. 1 shown with an extraction tool.
FIG. 4*a* is an end view of a knife segment used with the chipper knife and knife stop arrangement of FIG. 1
FIG. 4*b* is top plan view of the knife segment of FIG. 4*a*.

The ends of each chipper knife 24 part are supported and positioned by knife stops 29 shown in FIGS. 1 and 3. The knife stops 29 position the chipper knives 24 in the width direction so that the active cutting edges 93 are properly positioned to engage the incoming logs 32. Although a chipper knife preferably is composed of two parts, the chipper knife may extend the length of the knife clamp 28. The knife stops need not be continuous, such that knife stops may be positioned only at each end of a chipper knife or a discrete chipper knife part. The disc chipper 20 has a knife sector and a knife clamp 28 in each of fifteen 24° sections of the chipper disk 22, as shown in FIG. 4*b*. The chipper 20 is arranged to maximize time in service by providing for the ready replacement of the chipper knives 24 as they wear with regular operation of the chipper. A new double-edged chipper knife 24 starts out having a width of 4.5 inches corresponding to dimension B between the two parallel cutting edges 93. After the first edges 93 of the chipper knives 24 become dull, the chipper knives are removed from their clamping, and are rotated 180° degrees in a single plane to bring the other edges to the cutting position. After both edges 93 are dull, all thirty of the chipper knife parts (two parts for each of the fifteen knives) are removed from the chipper and sharpened so that each part now has a width which is 0.125 inches less than it was before sharpening. When the sharpened chipper knives 24 are reinstalled in the chipper 20, the original knife stops 29 are replaced with a second group of knife stops which are 0.125 inches longer with the result that the combined width of the chipper knives and the knife stops in the width direction is unchanged, and the active cutting edges remain in the proper cutting position. This process of using one edge, then the other, and then sharpening may be carried out twelve times, each time reducing the width of the chipper knives by 0.125 inches. Each time the chipper knives are reinstalled with a new group of knife stops which maintain the active cutting edges in the same cutting position. After the final sharpening the width of the chipper blades are 3.5 inches shown as a dashed line on the chipper knife in FIGS. 1 and 2. When the edges of the 3.5 inch chipper knives are worn on both edges, the chipper knives are removed from service.

With the dimension of the knife stop in the width direction being the dimension A as shown in FIG. 3, and the width of the knife blades in the width direction being the variable B, Table 1 shows that the original knife stops and 12 incrementally wider knife stops maintain the total width of the chipper knife and knife stops constant. Thus a total of thirteen incrementally longer knife stops are used as a set to allow twelve sharpenings of the chipper blades.

TABLE 1

| Sharpening step | Knife Stop A | Knife B | A + B= |
|---|---|---|---|
| 0 | 2.063 | 4.5 | 6.563 |
| 1 | 2.188 | 4.375 | 6.563 |
| 2 | 2.313 | 4.250 | 6.563 |
| 3 | 2.438 | 4.125 | 6.563 |
| 4 | 2.563 | 4.000 | 6.563 |
| 5 | 2.688 | 3.875 | 6.563 |
| 6 | 2.813 | 3.750 | 6.563 |
| 7 | 2.938 | 3.625 | 6.563 |
| 8 | 3.063 | 3.500 | 6.563 |
| 9 | 3.188 | 3.375 | 6.563 |
| 10 | 3.313 | 3.250 | 6.563 |
| 11 | 3.438 | 3.125 | 6.563 |
| 12 | 3.563 | 3.000 | 6.563 |

Although the chipper knives are expended after twelve sharpenings, the knife stops are not expended and are reused with the new chipper knives. However, in practice the chipper knives need not be resharpened immediately after they are worn. Instead, the chipper may be provided with multiple sets of chipper knives. For example, ten distinct sets of thirty chipper knife parts.

Thus, in practice ten or more sets of chipper knives can be used with the thirteen sets of knife stops so that the knife stops need only be changed after each chipper knife in all the sets has been sharpened. For example, if a given disc chipper has ten sets of new chipper knives, the first set of new chipper knives is installed with the first knife stops. The remaining nine sets of new chipper knives are stored. When the first edges are worn, the chipper knives are rotated to bring the second edges into cutting service, and the original first knife stops remain in place. When the second edges are worn, the first set of chipper knives is removed and stored, and the second set of chipper knives is brought out of storage and installed in the disc chipper, again with the same first knife stops. This procedure is repeated until the ten sets of chipper knives have been worn on both edges. At which point, the first knife stops are replaced with the second knife stops, and the first set of chipper knives, now sharpened, are reinstalled. Thus the knife stops are changed only once for twenty times when: the chipper knives are rotated or swapped out for a new or newly sharpened chipper knives. A chipper knife may be used for hours or days before it must be rotated or replaced, so the cycle time between re-sharpening of the knives will be weeks or months. If the same chipper knives do not need to be used in the same disc chipper the supply chain becomes even more flexible.

The knife segment 26 has an outer surface 30 which faces incoming logs 32 which move along a surface 34 of a log chute 36 as shown in FIG. 1. The knife segment 26, shown in FIGS. 4*a* and 4*b*, comprises one of fifteen knife segments which are mounted to the chipper disk 22 each occupying a 24° sector which is tangent to a circle through which the driveshaft (not shown) of the chipper disk 22 passes. The leading edge surface 38 of the knife segment 26 meets the outer surface 30 at an acute angle. The knife segment leading edge surface 38 extends away from the outer surface 30 and terminates at a back surface 40 which extends at a right angle to the leading edge surface and forms the upper half of the rectangular pocket 42 which holds a knife blade 24 and knife stop 29. As shown in FIG. 1, counter bores 41 extend from the leading edge surface 38 near the back surface 40, the counter bores receiving rare-earth magnets 43. The knife segment 26 has a bottom surface 44 which engages the chipper disc 22. The knife segment 26 is bolted to the chipper disc by clamping bolts 46 which are received in the chipper disc through holes 47. A rectangular foot 48 extends from the knife segment 26 below the bottom surface and into a groove 50 formed in the chipper disc 22 which serves to position the knife segment on the chipper disk. The rear surface 52 of the knife segment 26, as shown in FIGS. 2, 4A, and 4B, serves to deflect woodchips 54 to pass through a slot 49 the chipper disk 22 shown in FIG. 2.

Figure 5:
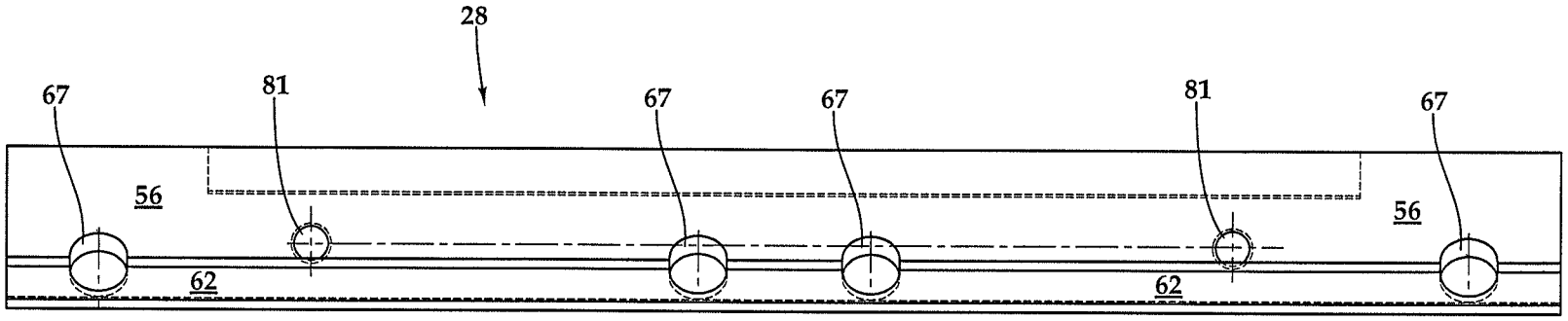
FIG. 5 is a top plan view of the knife clamp shown in section in FIGS. 1 and 2.
Figure 6:
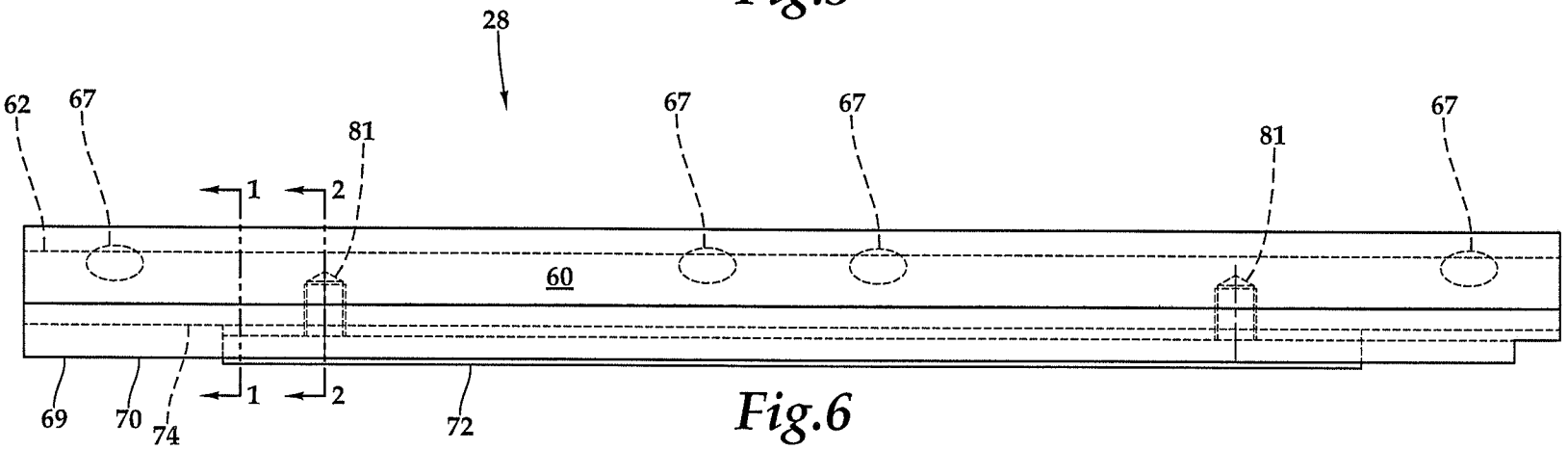
FIG. 6 is a side elevational view of the knife clamp of FIG. 5.

The knife clamp 28, as shown in FIGS. 1-2, and 5-6, has an upper surface 56 which forms the bottom of the rectangular pocket 42. The knife clamp 28 has a front downwardly extending surface 60 which extends away from the chipper knife 24. The forward surface 60 of the knife clamp 28 directs wood chips through the chipper disk 22 via the slot 49. The knife clamp 28 has a groove 62 which holds a counter knife 64, the groove extends to the upper surface 56 and the downwardly extending surface 60. The counter knife 64 has an upper surface 61 which extends in the same plane as the knife clamp upper surface 56 such that the counter knife 64 engages and supports a portion 65 of the bottom surface 94 of the knife blade 24. A hardened insert 66, for example of tungsten carbide, is brazed to the counter knife 64 just below the knife blade bottom surface 65 to resist wear caused by the woodchips impacting the counter knife. The knife clamp 28, as shown in FIG. 5, has four counter bores 67 which extend below the upper surface 56 and extend partly below the bottom of the groove 62 and are arranged to hold magnets 68 as shown in FIG. 1. The magnets 43, 68 may be rare earth shallow disc-shaped magnets such as neodymium magnets.

The knife clamp 28 has a bottom 69 which includes a front leg 70 which is narrower and shorter than a rear leg 72 with a groove 74 therebetween, which receives a land 76 extending upwardly from the chipper disc 22. The knife clamp rear leg 72 abuts the knife segment 26 rectangular foot 48 and extends into the groove 50 in the chipper disc 22, thereby positioning the knife clamp 28 on the chipper disk 22. The knife clamp 28 is engaged against the chipper knife blades 24 by two spring-loaded first bolts 78, one of which is shown in FIG. 1, which extend through bolt holes 79 in the chipper disc and screw into two threaded holes 81 in the knife clamp, shown in FIGS. 2 and 6. Counter bores 85 are formed on the underside of the chipper disc 22 around the first bolts 78, which receive springs 80 which bias the bolt heads 83 away from the chipper disk and which pull the knife clamp 28 toward the chipper disk. The bolt heads 83 may have hex sockets.

As shown in FIG. 1, a plurality of second bolts 82 engage threaded inserts 84 in the chipper disk 22. When the second bolts 82 are turned the bolt ends 88 press on a surface 89 defined within the groove 74, thus forcing the knife clamp 28 towards the knife segment 26. The second bolts 82 are turned to clamp the chipper knife 24 between the leading edge surface 38 on the knife segment 26 and the upper surface 56 of the knife clamp 28. A plurality, e.g. six, second bolts 82 are provided, which may be spaced on either side and between the first bolts 78 to clamp the chipper knives 24 to the knife segment 26.

The chipper knives 24 are thicker, e.g., 0.5 inches, than typical disposable knives but, like disposable knives, are double edged. The chipper knives 24 are positioned within the rectangular pocket 42 by knife stops 29 shown in FIG. 3. The knife stops 29 are rectangular in shape but have an inclined engagement surface 91 at one end, and a rear surface 31 at the opposite end. Each knife stop 29 has an upper surface 33 and a parallel lower surface 35. The rear surface 31 is perpendicular to the upper and lower surfaces 33, 35. The inclined engagement surfaces 91 of the knife stops match the inclined edge planes 92 of the chipper knives 24. For example, the chipper knife 24 cutting edge plane 92 may have an angle of 32° with respect to the chipper knife bottom surface 94, and an oblique angle of 148° with respect to the top surface 96 of the chipper knife. The knife stop 29 inclined engagement surfaces 91 are inclined to the same degree as the edge plane 92 of the chipper knife 24 except the inclined engagement surface 91 is brought to a flat point, e.g., 1/16 inch, so that the knife stop is not sharp. As shown in FIGS. 1 and 2 the knife stops 29 and the chipper knifes 24 are arranged with the inclined surfaces 91, 92 engaged. The knife stop 29 rear surface 31 engages against and is parallel to the back surface 40 of the knife segment 26 at the rear of the pocket 42.

Each knife stop 29 has a threaded hole 98 which extends through the inclined engagement surface 91 and which extends parallel to and partially along the width of the knife stop. As shown in FIG. 3, the threads in the hole 98 within the knife stop 29 can be engaged by a simple T-shaped tool 100 which has threads 102 on the longest end. When the disc chipper 20 is stopped for servicing, the tool 100 is rotated to engage its external threads 102 with the internally threaded hole 98 in the knife stop 29. Once engaged the tool and connected knife stop may be extracted from the rectangular pocket 42 and pulled away from the positioning magnets 43 mounted in the counter bores 41 of the surface 38 of the knife segment 26. A new set of knife stops 29 can be inserted using the same T-shaped tool 100. The new knife stops have a greater length to properly position the chipper knife segments after being shortened by sharpening.

When a worn chipper knife blade 24 inclined edger plane is engaged with the inclined surface 91 of a knife stop 29, there will not be complete engagement as a portion of the cutting edge plane 92 will be worn away. However, even if only a small portion remains of the surface of the original cutting edge plane 92, it will be sufficient to control the length of the chipper knife plus the knife stop. The knife stops 29 are used for positioning the chipper knives and do not bear a working load, as the working load is transmitted to the chipper disc by the clamping load between the knife clamps and the knife segments.

It should be understood that the back surface 40 forming part of the rectangular pocket 42 could be on the knife clamp as shown in FIG. 3 of U.S. Pat. No. 7,584,772 or on the chipper disk 22. And it should also be understood that the back surface 40 need not adjoin the leading edge surface 38 of the knife segment 26 or the upper surface 56 of the knife clamp 28, and the back surface need not be perpendicular to the leading edge surface 38 or the upper surface 56 but only serves to capture the knife stop 29 against movement, such that the pocket 40 need not be rectangular.

It should be understood that the chipper knives 24 are in the form of a metal bar having a longest dimension defining a length, a shortest dimension defining a thickness, and third dimension defining a width. For example 17.375 inches by 0.5 inches by 4.5 inches. The chipper knives have two tapered cutting edges 93 defined by the inclined edge planes 92 which extend along the length of the blade. These edge planes extend through the blade thickness. The distance between the two opposed edges 93 defines the blade width. Although the chipper knives 24 as shown in FIGS. 1 and 2 have a cross-section of a trapezoidal quadrilateral which is rotated in a single plane to change the cutting edge presented for chipping, the chipper knives could have a cross-section of a parallelogram which would require rotation in two planes to change the cutting edge presented for chipping.

It should be understood that the chipper knives 24 could have only one tapered cutting edge 93 defined by the inclined edge plane 92 which extend along the length of the blade and an opposed side extend which extends along the length of the chipper knife could have merely an engagement surface for engaging with a corresponding surface on the knife stops. In the case where the opposed side is only for engagement it can have an arbitrary shape, e.g., flat or stepped, which matches with the corresponding surface on the knife stops.

It is understood that the invention is not limited to the particular construction and arrangement of parts herein illustrated and described, but embraces all such modified forms thereof as come within the scope of the following claims.

I claim:

1. A disc chipper comprising:

a chipper disc;

a plurality of cutting assemblies fixed to the chipper disc, wherein each cutting assembly comprises:

a knife segment mounted to the chipper disk, the knife segment having portions defining a first chipper knife engaging surface which faces the chipper disc;

a chipper knife having cutting edges on opposed sides, the cutting edges being defined by inclined edge planes which extend between parallel top and bottom surfaces of the chipper knife;

a knife clamp having a second chipper knife engaging surface, the knife clamp being mounted to elastically bias the knife clamp toward the chipper disk, and having at least one second adjustable mechanism to bias the knife clamp away from the chipper disk to clamp the chipper knife between the knife segment first chipper knife engaging surface and the knife clamp second chipper knife engaging surface;

a back surface fixed with respect to the knife segment, the knife clamp or the chipper disk and together with the first chipper knife engaging surface and the second chipper knife engaging surface to define a pocket;

a knife stop mounted within the pocket and engaging the back surface, the knife stop having an inclined surface which supportively engages one of the inclined edge planes of the chipper knife within the pocket; and wherein the knife stop has portions defining a hole opening on the inclined surface for receiving an extraction tool.

2. The disc chipper of claim 1 wherein the knife stop portions defining a hole further define an inner threaded portion for receiving and engaging with threads on the extraction tool.

3. The disc chipper of claim 1 wherein the knife segment is bolted to the chipper disc, and wherein there are a plurality of first bolts arranged to elastically bias the knife clamp toward the chipper disk and a plurality of second bolts arranged to bias the knife clamp away from the chipper disk to clamp the chipper knife between the knife segment first chipper knife engaging surface and the knife clamp second chipper knife engaging surface.

4. The disc chipper of claim 1 wherein each of the plurality of cutting assemblies further comprises:

portions of the knife clamp defining a groove which extends below the second knife engaging surface;

a counter knife positioned in the groove, the counter knife having an upper surface which engages the bottom surface of the chipper knife and extends along the bottom surface of the chipper knife and protrudes beyond the knife clamp to prevent wear of the knife clamp;

portions of the knife clamp which define a plurality of counter bores; and a plurality of magnets, one mounted in each of the knife clamp counter bores such that the magnets at least partially engage the counter knife to hold the counter knife to the knife clamp.

5. A system of chipper knives and knife stops for use in a disc chipper used to chip wood logs for the production of wood fiber containing pulp; the system comprising:

a plurality of chipper knives, each chipper knife having a length, a width, and a thickness, wherein each chipper knife has an upper surface and a parallel lower surface, and along the length of the chipper knives at least one cutting edge plane extends from the upper surface to the lower surface to define a first cutting edge spaced in a width direction from a second engagement edge, the distance in the width direction between the first cutting edge and the second engagement edge defining the width of the chipper knife, and wherein each chipper knife of the plurality of chipper knives is releasably associated with the same chipper disc and extending within one of a plurality of pockets and positioned by a knife stop engaged against a back surface, said knife stop being one of a set of knife stops;

for each of the plurality of chipper knives, the set of knife stops comprises: a series of knife stops, in which a first knife stop is narrower in the width direction than a second knife stop, which is narrower in the width direction than a third knife stop, and each member of the series of knife stops is narrower than the subsequent member; and such that all the first knife stops of all the sets of knife stops for all the chipper knives are of the same width, and the subsequent knife stops of all the sets are wider than the previous knife stops; such that as the plurality of chipper knives are repeatedly removed from their pockets and sharpened to a common and narrower width, the chipper knives may be returned to their association with the chipper disc, and the combined width of each sharpened chipper knife in combination with one of the subsequent knife stops remains the same, so the plurality of chipper knives are similarly positioned in the disc chipper.

6. The system of chipper knives and knife stops of claim 5 wherein each chipper knife second engagement edge forms a second cutting edge which extends from the upper surface to the lower surface.

7. The system of chipper knives and knife stops of claim 5 wherein within each set of knife stops, the difference in width between the first knife stop and the second knife stop is the same as the difference in width between the second knife stop and the third knife stop.

8. The system of chipper knives and knife stops of claim 6 wherein each knife stop of the sets of knife stops has an inclined surface which is positionable to engage one of the plurality of chipper knives, and wherein each knife stop has portions adjoining said inclined surface which define an engagement for an extraction tool.

9. The system of chipper knives and knife stops of claim 8 wherein the portions adjoining said inclined surface define a hole opening on the inclined surface for receiving the extraction tool.

10. The system of chipper knives and knife stops of claim 9 wherein the knife stop portions defining a hole further define an inner threaded portion for receiving and engaging with threads on the extraction tool.

11. A method of sharpening and using a plurality of chipper knives in a disc chipper, wherein each chipper knife has a first cutting edge spaced in a width direction from a second engagement edge, the method comprising the steps of:

securing the plurality of chipper knives to a chipper disc, such that each chipper knife is engaged against a first knife stop of a first width in the width direction, wherein a combined width in the width direction of each combination of chipper knife and first stop is a first measure, and the first cutting edges are disposed to engage incoming wood logs;

using the plurality of chipper knives in the disc chipper to chip wood logs until the plurality of chipper knife first cutting edges become dull;

removing the plurality of chipper knives from the chipper disc;

sharpening the chipper knife first cutting edges, thereby decreasing the widths of the chipper knives;

removing the first knife stops and replacing them with second knife stops of a second width which is greater than the first width;

replacing the plurality of sharpened chipper knives to engage against the second knife stops and securing them to the chipper disc, wherein the combined width of the each replaced sharpened chipper knife and its engaged second knife stop is said first measure; and using the plurality of chipper knives in the disc chipper to chip wood logs.

12. The system of chipper knives and knife stops of claim 11 wherein the second engagement edge forms a second cutting edge.

13. The method of claim 12 wherein before the step of sharpening the chipper knife first cutting edges, further comprising the steps of:

replacing the chipper knives in engagement with the first knife stops such that the second cutting edges are disposed to engage incoming wood logs; and using the plurality of chipper knives in the disc chipper to chip wood logs until the plurality of chipper knife second cutting edges become dull.

14. The method of claim 13 further comprising the steps of:

removing the plurality of chipper knives, the second cutting edges of which have become dull from the chipper disc and storing said chipper knives;

replacing the plurality of chipper knives with a plurality of second chipper knives, each second chipper knife being secured to the chipper disc against one of said first knife stops, which the combined width in the width direction of each combination of second chipper knife and first stop is the first measure;

using the plurality of second chipper knives in the disc chipper to chip wood logs; and wherein the step of replacing the plurality of sharpened chipper knives to engage against the second knife stops and securing them to the chipper disc, is performed after a step of retrieving said stored chipper knives from a place of storage.

* * * * *